US011945072B1

(12) United States Patent
Thomas et al.

(10) Patent No.: US 11,945,072 B1
(45) Date of Patent: Apr. 2, 2024

(54) HIGH SPEED DRILL BIT SHARPENER

(71) Applicants: Bryan Chad Thomas, Dover, PA (US); Robert Eugene Kauffman, Biglerville, PA (US)

(72) Inventors: Bryan Chad Thomas, Dover, PA (US); Robert Eugene Kauffman, Biglerville, PA (US)

( * ) Notice: Subject to any disclaimer, the term of this patent is extended or adjusted under 35 U.S.C. 154(b) by 603 days.

(21) Appl. No.: 16/891,110

(22) Filed: Jun. 3, 2020

Related U.S. Application Data

(60) Provisional application No. 62/921,220, filed on Jun. 4, 2019.

(51) Int. Cl.
*B24B 3/26* (2006.01)
*B24B 3/24* (2006.01)

(52) U.S. Cl.
CPC ..... *B24B 3/265* (2013.01); *B24B 3/247* (2013.01)

(58) Field of Classification Search
CPC .. B24B 3/24; B24B 3/247; B24B 3/26; B24B 3/265; B24B 3/32; B24B 19/16
USPC ..... 451/48, 349, 375, 403, 404
See application file for complete search history.

(56) References Cited

U.S. PATENT DOCUMENTS 2,701,432 A * 2/1955 Kent ..... B23Q 16/04 409/222
3,742,652 A * 7/1973 Enders ..... B24B 3/26 451/180
3,769,757 A * 11/1973 Sunday, Jr. ..... B24B 3/26 451/344
4,858,389 A * 8/1989 Wurscher ..... B24B 3/26 451/241
5,618,028 A * 4/1997 Hepworth ..... B24B 3/26 451/406
5,676,591 A * 10/1997 Huang ..... B24B 3/265 451/349
6,116,995 A * 9/2000 Chao ..... B24B 3/265 451/48
6,676,500 B1 * 1/2004 Lin ..... B24B 3/265 76/108.6
8,864,554 B2 * 10/2014 Masalin ..... B24B 3/54 451/558
2013/0288580 A1 * 10/2013 Tamm ..... B24B 19/16 451/363
2013/0295824 A1 * 11/2013 Hasegawa ..... B24D 15/082 451/349

* cited by examiner

*Primary Examiner* — Brian D Keller
*Assistant Examiner* — Marcel T Dion
(74) *Attorney, Agent, or Firm* — Hooker & Habib, P.C.

(57) ABSTRACT

An apparatus comprising a cylindrical die holder base containing two recessed compartments, two different abrasive coated sharpen dies, a cylindrical index containing drill bit guide holes used to align drill bit dead center with the sharpening dies, male and female hemispheres on the index and the base to ensure alignment, a spring assembly allowing for separation of index from base while rotating index, a cylindrical safety guard used to cover index holes that are not aligned with sharpening dies, a locking knob used to lock and unlock index to base to allow or disallow rotation, and a radiused handle with a flat bottom used to safely hold drill sharpening device down on a flat surface while in use.

4 Claims, 9 Drawing Sheets

HIGH SPEED DRILL BIT SHARPENER

CROSS-REFERENCE TO RELATED APPLICATIONS

The present application claims priority to U.S. provisional patent application No. 62/921,220, filed on Jun. 4, 2019 The entire disclosure is included herein in it is at least by reference

BACKGROUND OF THE INVENTION

The present invention is in the field of drill bit sharpeners, and more particularly a drill bit sharpener not having a rotating grinding wheel to sharpen drill bits.

Drills and drilling machines are designed to make holes in objects. These devices use a drill bit to make holes in objects, a 'drill bit tip has a cutting edge with a relief angle to drill holes in objects. After prolonged use, the drill bit becomes dull and unusable. The user must replace the bit with a new drill bit. to continue drilling holes which is not cost effective.

To sharpen a dull drill bit is more cost effective than replacing it. A bench grinder with a rotating grinding wheel is often used to sharpen dull drill bits. The user holds the drill bit in his or her hands and uses the rotating grinding wheel to grind a cutting edge with the appropriate relief angle on the drill bit. Using a conventional bench grinder to sharpen drill bits has some drawbacks in both using and operating. The drawbacks include the following.

Disadvantages

Pedestal and bench grinders are large and occupy a lot of space. The bench grinder needs to be hooked up to a power source before it can be used. The bench grinder is not a portable device and must be mounted to a solid surface such as a workbench.

Holding the drill bit at the proper angle against the grinding wheel is not an easy task. It takes time and a skilled machinist to properly sharpen the drill tip accurately by hand'

In the art of drill bit sharpening devices, the device many times must be plugged into an electrical outlet or driven by another means to execute sharpening of the drill bit. A dull drill bit is usually placed inside a guide and aligned to the proper degree of angle of the drill bit. The device is energized, and the bit is usually slowly turned by hand until drill bit is sharpened One problem with these types of drill bit sharpeners, they take considerable time setting up and most times needs an electrical outlet or some other means to power the device. Therefore, what is clearly needed is a drill bit sharpener that needs no electrical power source and a means to reduce the time to set-up the drill bit sharpening angles for the device.

BRIEF SUMMARY OF THE INVENTION

The problem stated above is that most drill bit sharpeners need an electrical source or other means to power the device. The inventors therefore considered the functional components of a drill bit sharpener and considered what parts could be utilized or eliminated to increase speed and efficiency in the sharpening/honing a dull drill bit.

The present inventors realized in an inventive moment that if, the means to power the drill bit sharpener and the set up time to sharpen each bit was also removed there could potentially be a decrease in sharpening time and an increase in efficiency could result. The inventors therefore designed a drill bit sharpener that did not need a power source to operate and practically no set up time. A significant increase in efficiency results with no impediment to the sharpening of the dull drill bit.

Accordingly, in one embodiment of the present invention, a device for sharpening drill bits. The device uses two separate disks, the lower disk holds the two sharpening dies and the upper disk contain assorted sized drill bit guide holes.

In one embodiment, these disks can be made of plastic, PVC or any other material suited for the purpose.

In one embodiment, a drill bit sharpener with no need for an external electrical power source or other means to power it.

In one embodiment, a set of sharpening dies that need no need for adjustment to achieve the proper angle of the bit that will be sharpen.

Advantages of the Present Invention

For example: ½" Drill bit is dull and needs sharpened. It is a 118 degree twist drill bit.

User will loosen Splined Index Locking Knob (27).

Safety guard (56) has access slots (35) on FIG. 23 to rotate index. Holes in index align with 135 sharpening die and 118 sharpening die. Safety guard covers index holes that are not aligned with dies.

Turn index (50) to drill bit guide holes (21) to ½' hole on index, aligning ½" hole with 118 sharpening die (4) Located within Die Holder Base (49)

Tighten Splined Index Locking Knob (27), Locking index (50) to die holder base (49).

Insert ½" 118 degree high speed twist drill bit into index (50) ½" hole with drill bit locked in chuck of handheld powered drill.

With drill bit sharpener on solid surface, holding handle of sharpener in one hand and powered drill in other. Select reverse on powered drill, run at full speed while pushing downward exerting a downward force of about 5 pounds for 20 seconds.

Remove drill bit from sharpening device to check cutting edge of drill bit.

Depending on dullness of drill bit, may have to repeat steps 5 through 7 a couple times to sharpen.

Once sharp, user can continue drilling without having to remove drill bit from powered drill.

Drill bit sharpening device is not intended to repair damaged/broken drill bits, only to hone or sharpen dull drill bits.

Drill bit sharpening device will sharpen drill bit with powered drill turning the drill bit in reverse however it will also sharpen by running drill in forward. It is recommended running in reverse due to the geometry of the drill bit cutting and relief surfaces.

What makes this drill bit sharpening device unique compared to other drill bit sharpening devices that are patented and or on the market is:

The drill bit does not have to be removed from the drill to be re-sharpened.

The powered drill does the work of rotating the drill bit against the abrasive coated sharpening surface.

It is fast and easy to use.

Saves time and money.

DETAILED DESCRIPTION OF PREFERRED EMBODIMENT

The inventors provide a unique drill bit sharpening that needs no electrical power as to sharpen a drill bit or a need to make multiple adjustments to correctly set the degree of the sharpening angle for the drill bit to be sharpen. Instead the compound angled abrasive coated sharpening surface, allowing a simple rotation of the index to either the 118 sharpening die or 135 sharpening die of which degree of the drill bit to be sharpen.

Figure 1:
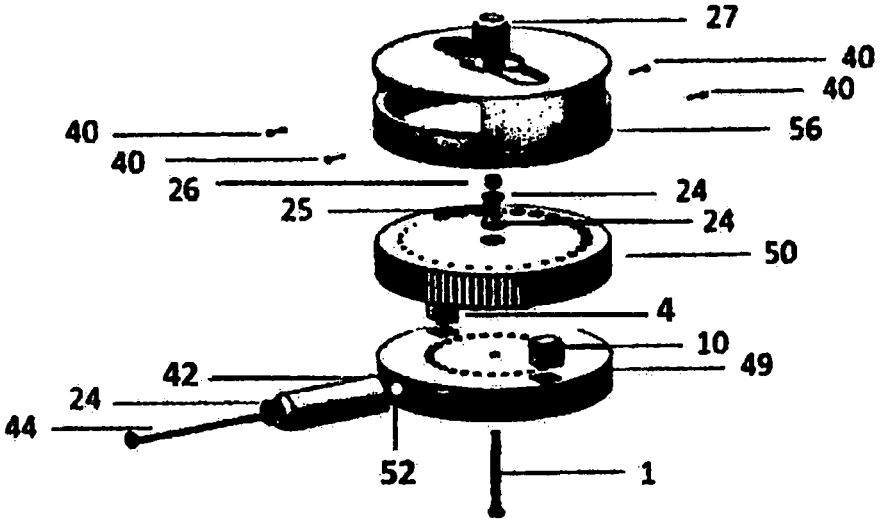
FIG. 1 is an 3D view of the English version according to the embodiment of the present invention.

FIG. 1 a complete 3D view of the English 29 hole version according to an embodiment of the invention. However, the 29 hole English version should not be construed as the limitation of the invention. This drill bit sharpener can range from one English drill bit guide hole index (50) to whatever range of index drill bit guides holes as to be used in this example.

Figure 2:
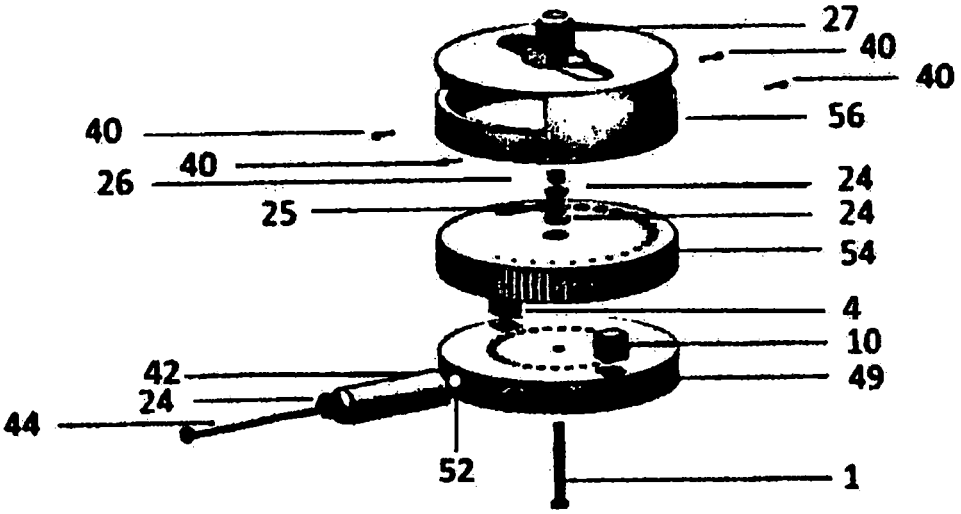
FIG. 2 is an 3D view of the Metric version according to the embodiment of the present invention.

FIG. 2 a complete 3D view of the Metric 25 hole version according to the embodiment of the present invention. However, the 25 hole Metric version should not be construed as the limitation of the invention. This drill bit sharpener can range from one Metric drill bit guide hole index (54) to whatever range of index drill bit guides holes are to be used in this example.

Figure 3:
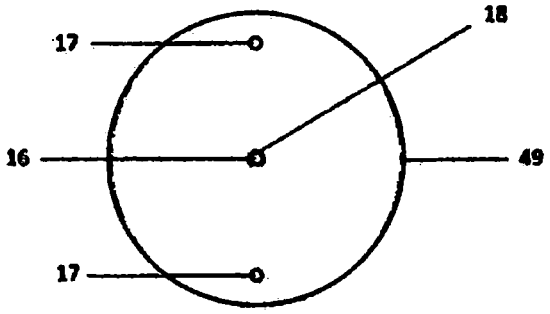
FIG. 3 is a bottom view of the die holder base according to the embodiment of the present invention.

FIG. 3 a 25-29 Metric/English Die Holder Base (49) bottom view. main alignment hole (16) holds the main parts of the sharpener assembly together of FIG. 1. There are two holes (17) that are used to easily push the die removal tool through to replace the abrasive coated surface sharpening dies. There is a recessed hex shaped hole (18) used to hold the head of the main assembly alignment bolt (1) from turning. The base (49), alignment hole (16), die removal holes, (17) and the hex shaped alignment bolt holder (18) may change diameter according to number of holes the index (50) contains in one embodiment of the invention.

Figure 4:
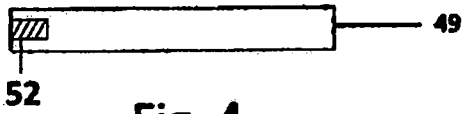
FIG. 4 is a side view of the die holder base according to the embodiment of the present invention.

FIG. 4 a 25-29 Metric/English Die Holder Base (49) side view. A threaded hole (52) for handle attachment bolt (44). Height and width may vary due to different number of drill bit guide holes according to an embodiment of the invention.

Figure 5:
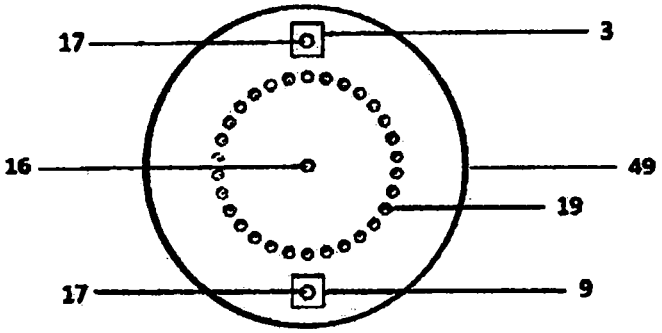
FIG. 5 is the top view of the die holder base according to the embodiment of the present invention.

FIG. 5 a 25-29 Metric/English Die Holder Base (49) top view. The 118 recessed die holder (3) used to hold an abrasive coated surface sharpening die, for a 118 degree drill bit (4). Recessed die holder (9) used to hold an abrasive coated surface sharpening die for a 135 degree drill bit (10), the assembly alignment hole (16), the die removal holes (17) used in conjunction with a die removal tool to easily remove worn dies, a circular pattern of female hemispheres (19) used to align the index guide holes to the 118 abrasive coated surface sharpening die, (4) or the 135 abrasive coated surface sharpening die, (10) in one embodiment of the invention. Number of hemispheres may change according to the different number of drill bit guide holes in the index of FIG. (16) and FIG. 19.

Figure 6:
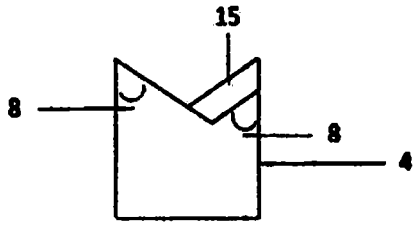
FIG. 6 is the front view of the 118 sharpening die showing reference numbers to the angles and an abrasive coated sharpening surface (7) according to the embodiment of the present invention.

FIG. 6 a 118 Sharpening Die (4) front view. This is one of the key parts of the invention, two of four angles (8) that makes this drill bit sharpener unique and an abrasive coated sharpening surface (15) as in one embodiment of the invention.

Figure 7:
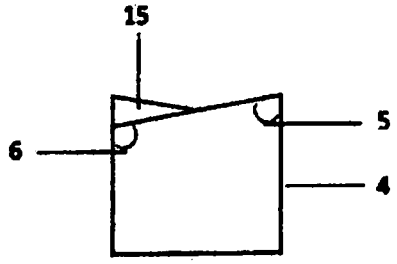
FIG. 7 is the right side view of the 118 die of FIG. 6

FIG. 7 a 118 Sharpening Die (4) Right Side View. an abrasive coated sharpening surface (15) used for sharpening of the drill bit. (5) and (6) are compound angles to ensure precise drill bit sharpening as in one embodiment of the invention.

Figure 8:
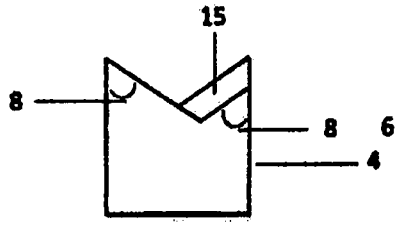
FIG. 8 is the rear view of the 118 die of FIG. 6.

FIG. 8 a 118 Sharpening Die (4) rear view. This is one of the key parts of the invention, two of four angles of a compound angled die (8) and an abrasive coated sharpening surface (15) as in one embodiment of the invention.

Figure 9:
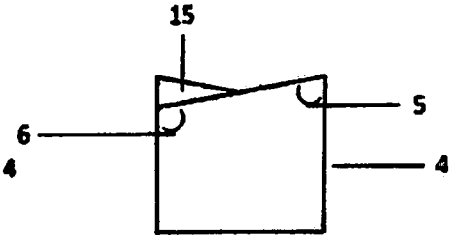
FIG. 9 is the left side view of the 118 die of FIG. 6

FIG. 9 a 118 Sharpening Die (4) Left Side View. an abrasive coated sharpening surface (15) used for sharpening of a drill bit. (5) and (6) are compound angles to ensure precise drill bit sharpening as in one embodiment of the invention.

Figure 10:
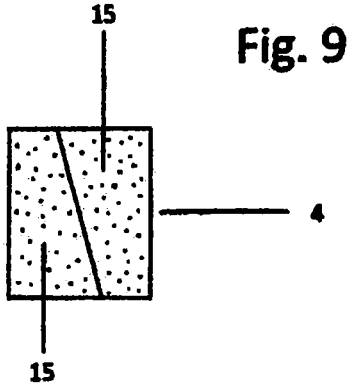
FIG. 10 is the top view of the 118 die of FIG. 6

FIG. 10 a 118 Sharpening Die (4) Top View showing the two abrasive coated sharpening surface (15) used for the sharpening of the drill bit according to in one embodiment of the invention.

Figure 11:
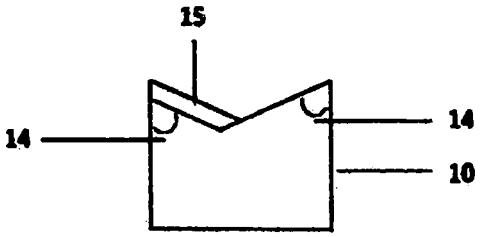
FIG. 11 is the front view of the 135 sharpening die showing reference numbers to the angles and an abrasive coated sharpening surface according to the embodiment of the present invention.

FIG. 11 a 135 Sharpening Die (10) front view. This is one of the key parts of the invention that makes this drill bit sharpener unique, two of four angles (14) and an abrasive coated sharpening surface (15) in one embodiment of the invention.

Figure 12:
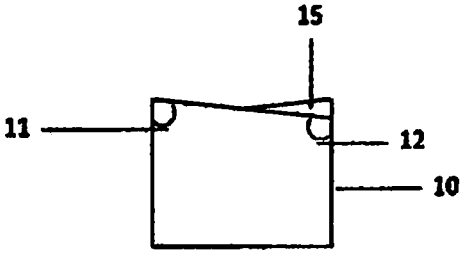
FIG. 12 is the right side view of the 135 die of FIG. 11

FIG. 12 a 135 Sharpening Die (10) Right Side View. an abrasive coated sharpening surface (15) used for sharpening of a drill bit. (11) and (12) are compound angles to ensure precise drill bit sharpening in one embodiment of the invention.

Figure 13:
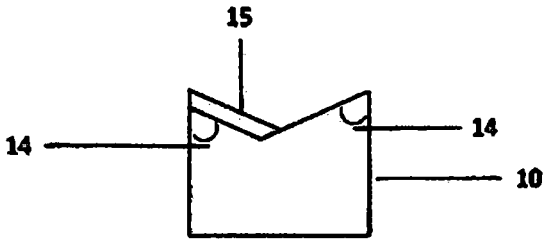
FIG. 13 is the rear view of the 135 die of FIG. 11

FIG. 13 a 135 Sharpening Die (10) Rear View. This is one of the key parts of the invention, two of four compound angles (14) and an abrasive coated or sharpening surface (15) in one embodiment of the invention.

Figure 14:
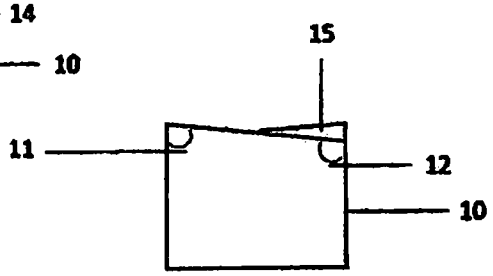
FIG. 14 is the left side view of the 135 die of FIG. 11

FIG. 14 a 135 Sharpening Die (10) Left Side View. an abrasive coated sharpening surface (15) used for sharpening of the drill bit. (11) and (12) are compound angles to ensure precise drill bit sharpening in one embodiment of the invention.

Figure 15:
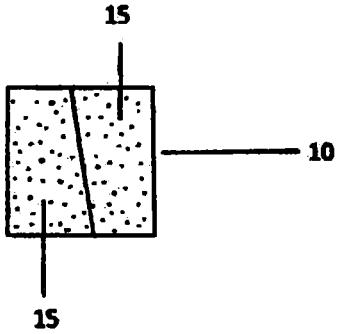
FIG. 15 is the top view of the 135 die of FIG. 11

FIG. 15 a 135 Sharpening Die (10) Top View showing the two abrasive coated surface (15) used for the sharpening of the drill bit in one embodiment of the invention.

Figure 16:
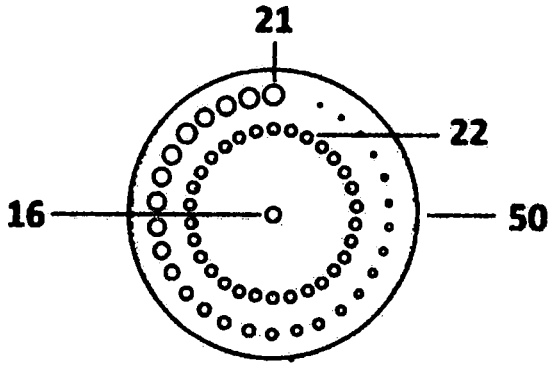
FIG. 16 is the bottom view of the English index in one embodiment of the invention.

FIG. 16 a 29 Hole English Index (50) Bottom View showing 29 index guide holes (21) ranging from 1/16"-½". Main assembly alignment hole (16) and male hemispheres (22) that interlock with the die base female hemispheres (19) to ensure perfect alignment of index guide holes (21) to the 118 abrasive coated sharpening die (4) or 135 abrasive coated surface sharpening die (10) in one embodiment of the invention.

Figure 17:
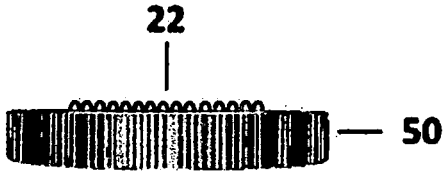
FIG. 17 is the side view of the index of FIG. 16

FIG. 17 a 29 Hole English index side view (50) Side View showing male hemispheres (22) Height and width can vary due to the different number of drill bit guide holes (21) in the index in one embodiments of the invention.

Figure 18:
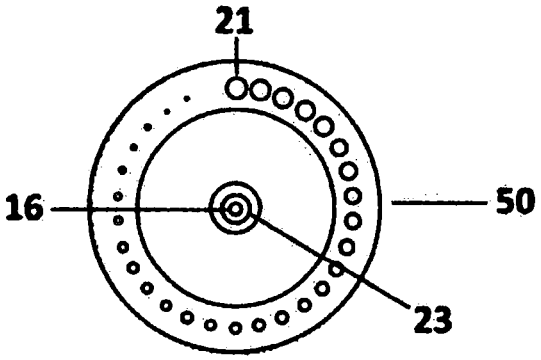
FIG. 18 is the top view of the index of FIG. 16

FIG. 18 a 29 Hole English Index (50) Top View showing 29 drill bit guide holes (21) ranging from 1/16"-½". Main assembly alignment bolt hole (16) and a recessed hole to house spring assembly reference numbers (24) washers, (25) spring and (26) nut located in FIG. 1 according to an embodiment of the invention.

Figure 19:
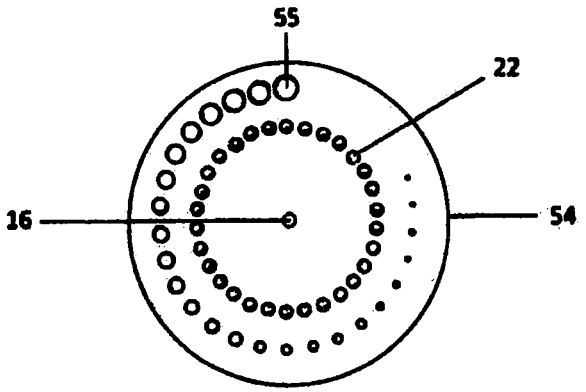
FIG. 19 is the bottom view of the Metric index in one embodiment of the invention.

FIG. 19 a 25 Hole metric Index (54) Bottom View showing 25 drill bit guide holes (55) ranging from 1 mm to 13 mm in 0.5 mm increments. Main assembly alignment bolt hole (16) and male hemispheres (22) that interlock with the die base (49) female hemispheres (19) to ensure precise alignment of index guide holes (55) to the 118 abrasive coated surface sharpening die (4) or 135 abrasive coated surface sharpening die (10) in one embodiment of the invention.

Figure 20:
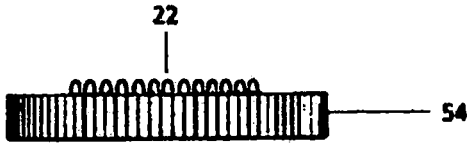
FIG. 20 is the side view of the index of FIG. 19

FIG. 20 a 25 Metrix Index Base (54) Side View showing male hemispheres (22). Die base height and width can vary due to the different number of drill bit guide holes in the index in one embodiment of the invention.

Figure 21:
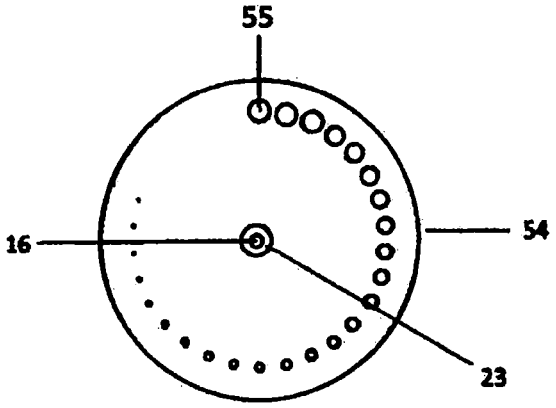
FIG. 21 is the top view of the index of FIG. 19

FIG. 21 a 25 Hole Metric Index (54) Top View showing 25 drill bit guide holes (21) ranging from 1 mm-13 mm in 0.5 mm increments. Main assembly alignment bolt hole (16) and a recessed hole (23) used to house part of the spring assembly (24) washers, (25) spring and (26) nut in one embodiment of the invention.

Figure 22:
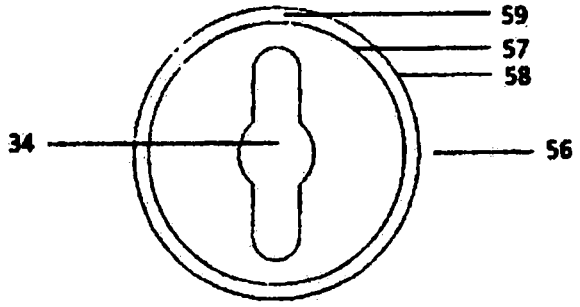
FIG. 22 is the bottom view of the safety guard in one embodiment of the invention.

FIG. 22 a 25-29 Hole Metric/English Safety Guard (56) Bottom View showing Die and locking nut access slot (34) and safety guard wall width (59) the inner (57) and the outer (58). Guard can change dimensions according to size of base used in one embodiment of the invention.

Figure 23:
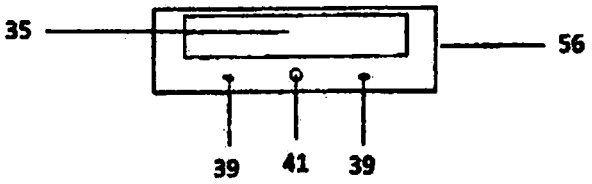
FIG. 23 is the front view of the safety guard of FIG. 22

FIG. 23 a 25-29 Hole Metric/English Safety Guard (56) Front View showing index access slot (35) to allow access to knurled side of index (50) of FIG. 17 as to rotate to the proper size drill bit guide hole (21) to the correct abrasive coated era file-like surface sharpening die (4) of FIG. 6 or (10) of FIG. 11. Holes (39) is for safety guard attachment to die holder base with screws (40) and Hole (41) for bolt to attach handle to die holder base in one embodiment of the invention.

Figure 24:
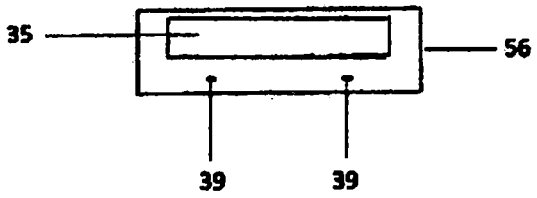
FIG. 24 is the rear view of the safety guard of FIG. 22

FIG. 24 a 25-29 Hole Metric/English Safety Guard (56) Rear View showing Index access slot (35) and holes (39) for safety guard attachment to die base in one embodiment of the invention.

Figure 25:
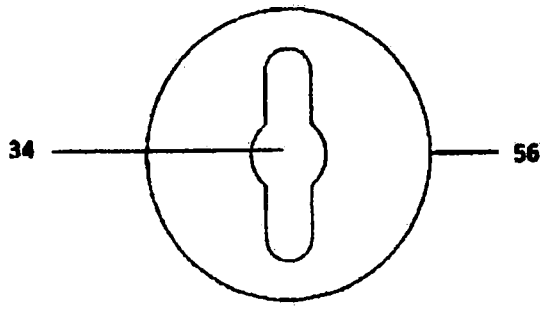
FIG. 25 is the top view of the safety guard of FIG. 22

FIG. 25 a Hole Metric/English Safety Guard (56) Top View showing Index drill guide holes and locking knob access slot (34) in one embodiment of the invention.

Figure 26:
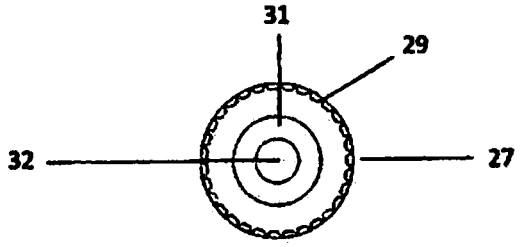
FIG. 26 is the bottom view of the locking knob in one embodiment of the invention.

FIG. 26 an Index Locking Knob (27) showing knurled edges (29), recessed hole (31) to allow spring assembly and lock nut clearance. Threaded recessed hole (32) allow locking knob to screw onto assembly alignment bolt (1) as to lock Index, in one embodiment of the invention.

Figure 27:
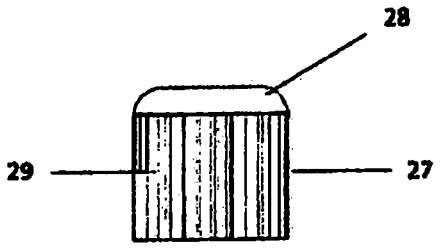
FIG. 27 is the side view of the locking knob of FIG. 26

FIG. 27 an Index Locking Knob (27) Side View Showing knurled edges (29) for easy grip of knob to rotate and lock index in position and a rounded top (28) for comfortably holding knob in one embodiment of the invention.

Figure 28:
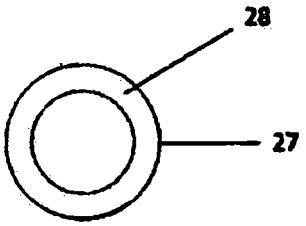
FIG. 28 is the top view of the locking knob of FIG. 26

FIG. 28 an Index Locking Knob (27) Top View Showing rounded top (28) for comfortably holding knob in one embodiment of the invention.

Figure 29:
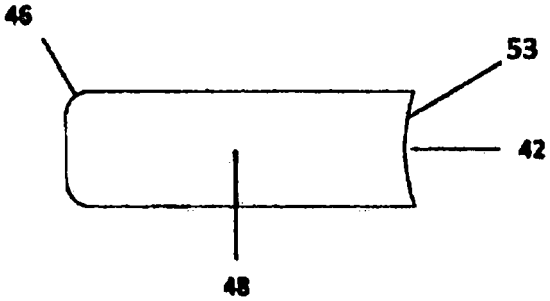
FIG. 29 is the bottom view of the handle according to one embodiment of the invention.

FIG. 29 a 25-29 Metric/English handle (42) Bottom View Showing a rounded rear edge (46) for comfort of the hand while handling and a radius front edge (45) to match radius of safety guard which may change according to size of base used in one embodiment of the invention.

Figure 30:
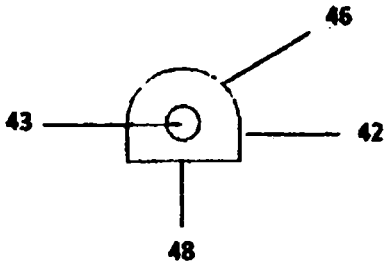
FIG. 30 is the front view of the handle of FIG. 29 showing curved radius of the handle and the hole for the attachment bolt.

FIG. 30 a Handle (42) Front View showing curved radius (46) of the handle and a hole (43) through the handle for the handle attachment bolt (44) of FIG. 1 and a flat bottom (48) in one embodiment of the invention.

Figure 31:
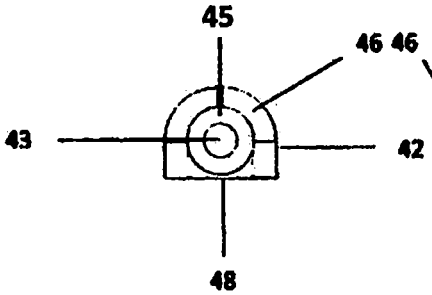
FIG. 31 is the rear view of the handle of FIG. 29 showing the attachment hole, curved rear radius for comfort and the recessed hole for handle attachment bolt head.

FIG. 31 a Handle (42) Rear View showing the handle attachment hole (43), curved rear radius (46) for hand comfort while holding the device, a counterbored of hole (42) to house the head of the handle mounting bolt in one embodiment of the invention.

Figure 32:
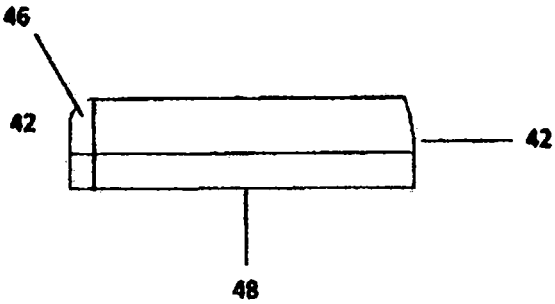
FIG. 32 is the side view of handle of FIG. 29 showing curved radius at the rear of the handle and a flat bottom.

FIG. 32 a Handle (42) Side View showing curved radius (46) at the rear of the handle and a flat bottom (48) in one embodiment of the invention.

Figure 33:
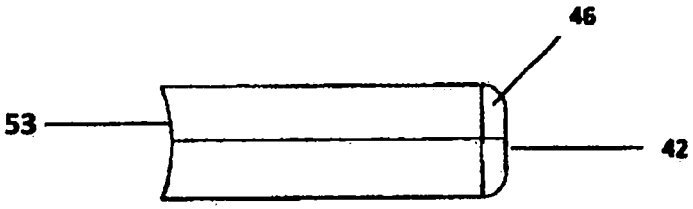
FIG. 33 is the top view of the handle of FIG. 29 showing front and rear curved radius.

FIG. 33 a Handle (42) Top View showing front curved radius (45) that mates with the safety guard (56) and rear curved radius (46) for comfort of the hand while holding the device in one embodiment of the invention.

It will be apparent to one with skill in the art that the drill sharpening device may be provided using some or all the mentioned features without departing from the spirit and scope of the present invention.

The embodiments described above are specific examples of a single broader invention that may have greater scope than any of the singular descriptions taught. There may be alterations made in the descriptions without departing from the spirit and scope of the present invention.

What is claimed:

1. An apparatus for sharpening or honing drill bits comprising:

a cylindrical die holder base containing two recessed compartments, each recessed compartment housing a sharpening die for sharpening drill bits, the die holder base further comprising a plurality of upwardly facing female alignment hemispheres;

each of the sharpening dies comprising a pair of angled sharpening surfaces which intersect in a central portion of the sharpening die to form an upwardly facing sharpening recess configured to sharpen drill bit tips, wherein the sharpening surfaces of a first one of the sharpening dies are arranged at a first angle, the sharpening surfaces of a second one of the sharpening dies are arranged at a second angle which differs from the first angle, and wherein each of the sharpening surfaces on each of the sharpening dies are coated with an abrasive;

a cylindrical index comprising a plurality of downwardly facing male alignment hemispheres and a plurality of index holes, wherein the male alignment hemispheres align and interlock with the female alignment hemispheres of the die holder base to align at least one of the index holes with one of the upwardly facing sharpening recesses of the sharpening dies;

a cylindrical safety guard covering the index and comprising a locking knob access slot housing a locking knob having a threaded recess hole screwed onto an assembly alignment bolt, wherein the locking knob can be loosened or tightened to the assembly alignment bolt in order to allow or disallow rotation of the index relative to the base, wherein the safety guard covers index holes which are not aligned with the sharpening recesses of the sharpening dies and the locking knob access slot allows access to index holes which are aligned with the sharpening recesses of the sharpening die, and the safety guard further comprising an index access slot in an outer surface thereof, allowing access to the index for rotation of the index;

a spring assembly between the safety guard and the index configured to maintain alignment of the male alignment hemispheres and female alignment hemispheres when the locking knob is loosened; and a handle attached to the safety guard and having a flat bottom surface configured to rest on a flat surface during use of the apparatus.

2. The apparatus according to claim 1, wherein the abrasive coating the sharpening surfaces is a diamond abrasive.

3. The apparatus according to claim 1, wherein an outer surface of the locking knob is knurled or splined to facilitate gripping while rotating the knob.

4. The apparatus according to claim 1, wherein a top surface and a rear surface of the handle is curved for comfort of a user while holding the apparatus.

* * * * *